United States Patent [19]

Klintenstedt et al.

[11] Patent Number: 4,710,160

[45] Date of Patent: Dec. 1, 1987

[54] CENTRIFUGAL SEPARATOR

[75] Inventors: Kjell Klintenstedt, Nacka; Zoltan Földhazy, Tumba, both of Sweden; Björn Forsberg, Hörsholm, Denmark

[73] Assignee: Alfa-Laval AB, Tumba, Sweden

[21] Appl. No.: 844,387

[22] PCT Filed: Jun. 13, 1985

[86] PCT No.: PCT/SE85/00249

§ 371 Date: Jan. 15, 1986

§ 102(e) Date: Jan. 15, 1986

[87] PCT Pub. No.: WO86/00029

PCT Pub. Date: Jan. 3, 1986

[30] Foreign Application Priority Data

Jun. 14, 1984 [SE] Sweden ..... 8403182

[51] Int. Cl.[4] ..... B04B 15/06

[52] U.S. Cl. ..... 494/64

[58] Field of Search ..... 494/43, 38, 60, 64, 494/65, 35, 36, 40; 210/360.1, 781, 782

[56] References Cited

U.S. PATENT DOCUMENTS

| | | | |
|---|---|---|---|
| 2,668,658 | 2/1954 | Peltzer | 494/35 |
| 3,408,000 | 10/1968 | Nilson | 494/65 |
| 4,026,462 | 5/1977 | Tenthoff | 494/43 |
| 4,067,494 | 1/1978 | Willus | 494/65 |
| 4,464,163 | 8/1984 | Heckmann | 494/64 |

*Primary Examiner*—Robert W. Jenkins

*Attorney, Agent, or Firm*—Cyrus S. Hapgood

[57] ABSTRACT

Centrifugal separator, the separation chamber (9) of which is surrounded by a first rotor part (1) and a second rotor part (2), an annular flange portion (3) of the first rotor part (1) being axially inserted into a sleeve formed end portion (5) of the second rotor part (2) and connected thereto by means of a locking joint. The locking joint comprises locking elements (8), which are brought radially outwards from a position radially inside said sleeve formed end portion (5) and axially outside said annular flange portion (3), such that one part of each locking element (8) is located in an internal recess (7) in the sleeve formed end portion (5), whereas the remaining part of the locking element (8) is located radially inside the periphery of said flange portion 3, whereby the locking element 8 is arranged to transmit axial forces from the first rotor part (1) to the second rotor part (2). In order to position the various parts of the locking joint relative to each other, the locking joint is provided with a pre-stressing element (10), which has a radially outer portion (11) abutting against a substantially axially directed surface of said sleeve formed end portion (5), preferably against its end surface, and which is arranged by means of a pre-stressing member (12) to be connected with said first rotor part (1) and to pre-stress it via the locking elements (8) against the second rotor part (2).

7 Claims, 3 Drawing Figures

CENTRIFUGAL SEPARATOR

Figure 1:
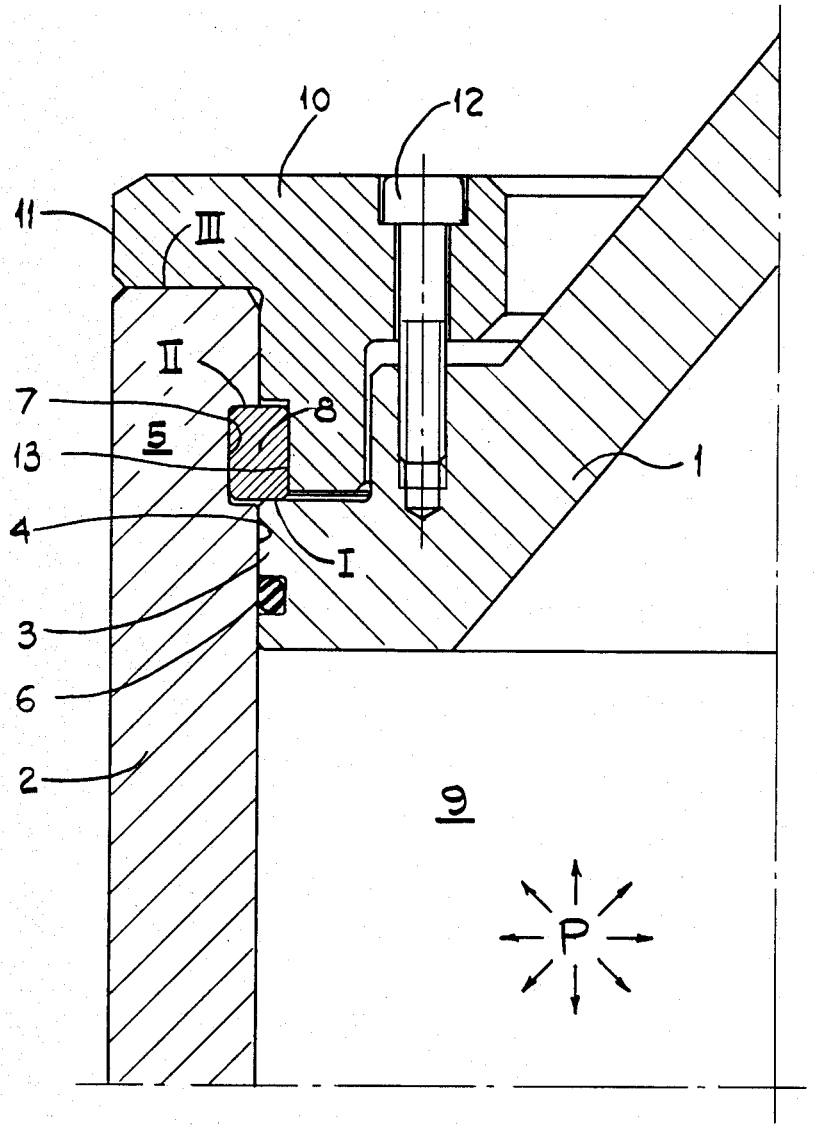

The present invention concerns a centrifugal separator comprising a first and a second rotor part, which together surround a separation chamber, a flange portion of the first rotor part being axially inserted into a sleeve formed end portion of the second rotor part and connected thereto by means of a locking joint. The locking joint comprises at least one locking member, which from a position radially inside said sleeve formed end portion and axially outside said annular flange portion has been moved radially outwards, so that part of the locking member is located in an internal recess in the sleeve formed end portion, while the remaining part of the locking member is located radially inside the periphery of said flange portion, whereby the locking member is arranged to transmit to said second rotor part axial forces arising during operation of the rotor and acting against the inside of said first rotor part.

For interconnecting the rotor main parts of high speed centrifugal separators there are used screw joints or shear-ring joints. Among the screw joints there are principally, on the one hand, joints with a threaded locking ring and, on the other hand, joints with threaded bolts. Joints with a threaded locking ring are clearly dominating in the large group of centrifuges having no movable sludge conveyor, fo which group a conical separation chamber contour—resulting in a relatively large radius of the rotor body—is necessary for the transport of sludge to peripheral sludge outlets or nozzle openings. In a common design there is formed at the largest radius of the rotor body an internally threaded cylindrical sleeve portion, into which there is inserted a rotor cover that is locked by means of a locking ring threaded into said sleeve portion. During operation the liquid pressure in the separator will create a separating axial force on the rotor cover and the rotor body, which force has be be taken up by the thread-engagement between the locking ring and said sleeve portion, if the locking ring should not be pressed out of the sleeve portion. As said sleeve portion is also subjected to large centrifugal forces in the radial direction, which forces try to separate the sleeve portion from the locking ring, it is realized that there are extraordinary demands on correct dimensioning and on construction material for both the locking ring and the rotor body.

In the group of centrifuges named decanters, having a relatively elongated rotor body and a sludge conveyor for ter transport of sludge normally to one end of the rotor body, bolt joints are dominating for the connection of the rotor end walls to the rotor body or drum. In a conventional decanter the rotor is provided with radially outwards extending flanges at the ends, at which flanges the rotor end walls are fixed by means of a large number of bolts. The largest stress in a rotating flange joint of this kind occurs at the threaded holes in the flange, and even if the drum is made of a special casting material the flange joint itself limits the peripheral speed that can be allowed. Further, assembling and the disassembling of the rotor are time consuming operations owing to the large number of bolts and owing to security measures, for instance for the obtainment of correct tightening moments. The high load on the bolt joint in the axial as well as the radial direction leads to complicated calculations concerning tightening moment, wear of the threads, and endurance. The difficulty is highly increased with increasing peripheral speed. Besides, projecting bolts or holes for socket head cap screws at a large radius result in an annoying noise generation.

One example of a centrifugal separator, in which the rotor main parts are interconnected by means of a shear-ring joint, is shown in the U.S. specification No. 2,668,658. The shear-ring disclosed is expanded from a position radially inside of the sleeve formed end portion of the rotor body itself outwards into an internal groove therein, and is pressing the rotor cover axially against an internal shoulder of the rotor body.

Interconnection of the rotor main parts in this way reduces the above mentioned problems concerning dimensioning, choice of material, assembling, generation of noise, and security. However, the method of joining the rotor main parts shown in said U.S. patent specification has certain limitations. Thus, if pre-stressing of the joint is desired, this can be accomplished only in a way creating undesirable, substantial radial forces, meaning that the sleeve formed end portion of the rotor is expanded radially and, accordingly, moved away from the flange portion of the the other rotor part. During the operation of the rotor this may result in mutual radial displacement between the rotor parts, leading to unbalance of the rotor.

The object of the present invention is to provide a centrifugal separator of the initially described kind, in which the main parts of the rotor are interconnected by means of a locking joint designed such that the above mentioned problems associated with threaded joints for the inter-connection of rotor parts are reduced, and such that the joint can be pre-stressed without creation of substantial radial forces, whereby the risk of a radial play is reduced.

According to the invention this can be achieved by providing a centrifugal separator of the initially defined kind with a pre-stressing element for pre-stressing the locking joint, which element has a radially outer portion abutting against an essentially axially facing surface of said sleeve formed end portion, preferably against its end surface, and which element is arranged by means of a pre-stressing member to be connected with the first rotor part and to pre-stress it axially via the locking element against the second rotor part.

By this invention it is possible to provide a centrifugal separator, in which the main parts of the rotor are joined together and pre-stressed by means of a locking joint in a way such that the liquid pressure created in the separating chamber during operation increases on the contact pressure between the axially against each other directed contact surfaces of the rotor parts, whereas it decreases the stress of the members, used for the pre-stressing purpose.

By the invention it is also possible to provide a centrifuge of the decanter type, in which there is no need of projecting flanges, internal or external, at the ends of the drum, and associated notches at the flanges and the bolt holes. Thereby, the manufacture of a rotor is simplified, because the drum can be made from a pre-fabricated tube, for instance.

In order to make it possible to bring the locking element outwards into the recess in said sleeve formed end portion, the locking element is formed of a ring, which is either cut off at one place, so that it can be expanded out into an internal annular groove in said sleeve formed end portion after it has been inserted into the latter, or divided into preferably two ring sections, which can be placed in such a groove. The ring or the ring sections, further, should be dimensioned and designed in a way such that sufficient abutment is offered on the one hand between its axially outer end surface and the axially outer end surface of the groove in said sleeve formed portion, and on the other hand between its axially inner end surface and the flange portion of said first rotor part.

Since the ring or the ring sections, owing to the centrifugal force, form a load acting radially on the surrounding rotor part, the ring (or the ring sections) according to a special embodiment of the invention is made conical in the axial direction, so that the above mentioned abutment is guaranteed with a minimum total mass of the ring. The annular groove in the surrounding rotor part preferably has a form adapted to the form of the conical ring.

Figure 2:
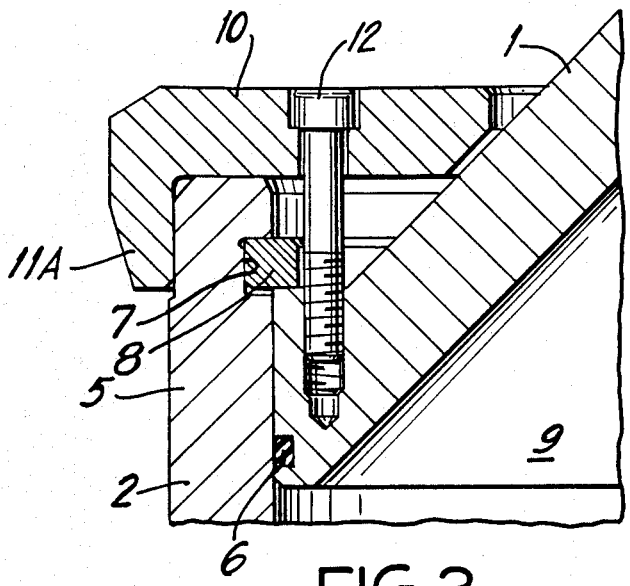
Figure 3:
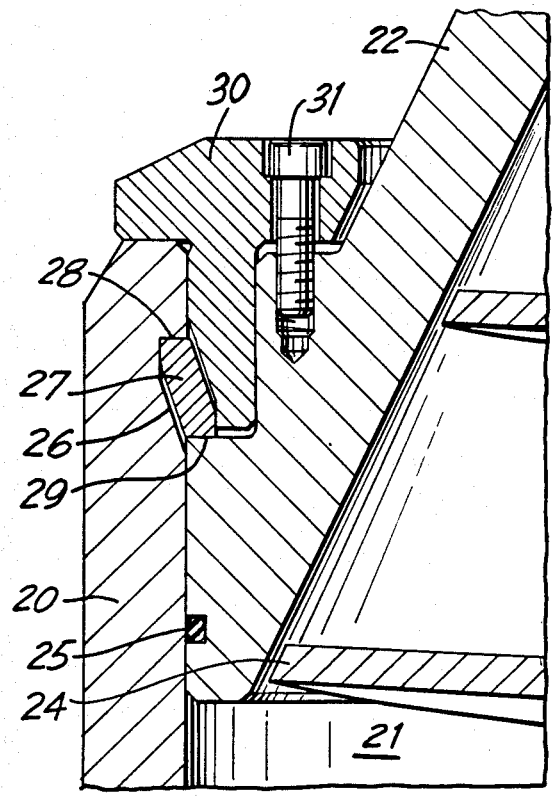

The invention will be further explained by means of some preferred embodiments thereof with reference to the acompanying drawing, in which FIG. 1 shows in section a part of a locking joint according to the invention between two rotor parts of a centrifuge, FIG. 2 shows in section a part of a modified embodiment of the locking joint in FIG. 1, and FIG. 3 shows in section a part of a decanter centrifuge to which a further embodiment of a locking joint according to the invention has been applied.

In the locking joint shown in FIG. 1, a rotor cover or end portion 1 is mounted in a rotor body or drum 2, an annular flange portion 3 of the end portion 1 being fitting a cylindrical internal surface 4 of a sleeve formed end portion 5 of the drum 2. The end portion 1 is sealed against the drum 2 by means of an annular gasket 6. A locking element 8 in the form of a shear-ring or a shear-ring section is inserted into an annular groove 7 on the inside of the end portion 5. When a liquid pressure P is created within the separation chamber 9 in the rotor, the end portion 1 is pressed axially against the locking element 8 at a pressure zone I. The axial force is transmitted by the locking element 8 to the drum 2 at a pressure zone II.

At a pressure zone III an annular pre-stressing element 10 abuts via an annular flange 11 against the end surface of the drum 2. By means of pre-stressing members in the form of bolts 12 the pre-stressing element 10 is secured to the end portion 1, which is thus prestressed axially against the drum 2 via the locking element 8. The pre-stressing element 10 further is provided with a recess 13 which is so formed that the locking element 8 is retained in the internal groove 7 in the drum 2.

Upon an increased pressure P the pressure in the pressure zones I and II increases, whereas the pressure in the zone III is reduced, meaning that the bolts 12 are unloaded. The location of the bolt joint at a smaller radius than the largest radius of the rotor results in a correspondingly smaller stress thereon derived from the centrifugal force. Further it is realized that the drum 2, in contrast to a drum having a conventional bolt joint between the drum and the end portion, can be designed without any projecting flange. This means that the stored energy in the drum 2, compared to the stored energy in a drum with a conventional bolt joint, can be reduced by about 15–20% for the same rotational speed, or that the peripheral speed of a centrifuge according to the invention can be increased correspondingly without exceeding of the permitted maximum strain on the drum material. The flangeless design also opens a possibility to manufacture drums of pre-fabricated tubes having a calibrated inner diameter.

FIG. 2 shows a modification of the locking joint in FIG. 1, corresponding details having been allotted the same reference numbers. The pre-stressing element 10 in this case has no part projecting into the drum 2 and fixing the position of the locking element 8. Instead, the locking element 8 is fixed by means of the radial position of the bolts 12. The prestressing element 10 further is provided with a flange llA surrounding the end portion of the drum 2, whereby the prestressing element 10 also serves as a stiffening means for the drum 2 and counteracts possible deflection of the end portion of the drum, caused by the rotation.

FIG. 3 shows a decanter having a circular cylindrical drum 20 with a separation chamber 21. A screw conveyor 24 is provided in the separation chamber for transporting sludge to a sludge outlet (not shown).

A rotor end portion 22 is inserted into the end portion of the drum 20 shown in FIG. 3, and is sealed against the same by means of a gasket ring 25. A recess 26 in the drum is shaped for a shear-ring section 27 converging conically from an axially outer surface 28, which is located essentially radially outside the drum wall inside and which is resting against an aixally outer surface of the groove 26, an axially inner surface 29, which is located esentially radially inside of the drum wall and is resting against the end portion 22 of the rotor. The position of the shear-ring section 27 is fixed, and the end portion 22 of the rotor is secured to the drum 20, by means of a prestressing ring 30, fixed to the end portion 22 by bolts 31.

By designing a centrifugal separator according to the invention it is possible to pre-stress a joint between the main parts of the centrifuge rotor, and to ensure the necessary positioning of the integral parts of the joint during normal operation of the rotor as well as during rotation of the rotor with an empty separation chamber without causing radial forces acting to separate said main parts. Besides, it has proved that a joint which is pre-stressed in this way has a better bending resistance.

The above described bolted shear-ring joint according to the invention can not be ranked equal with the above mentioned bolted flange joint of the conventional type. Since the task of the bolts in the shear-ring joint is only to keep the rotor parts together after assembling and in connection with starting of the separator, a far less number of bolts is required than at a conventional flange joint. The bolts can also be placed at a comparatively small radius, where the centrifugal forces are relatively small.

We claim:

1. Centrifugal separator comprising a first and a second rotor part (1, 2), which together surround a separation chamber (9), an annular flange portion (3) of the first rotor part (1) being axially inserted into a sleeve formed end portion (5) of the second rotor part (2) and connected thereto by means of a locking joint comprising at least one locking member (8), which from a position radially inside said sleeve formed end portion (5) and axially outside said annular flange portion (3) has been moved radially outwards, so that part of the locking member (8) is located in an internal recess (7) in the sleeve formed end portion (5), while the remaining part of the locking member (8) is located radially inside the periphery of said flange portion (3), whereby the locking member (8) is arranged to transmit to said second rotor part (2) axial forces arising during operation of the rotor and acting against the inside of said first rotor part (1), characterized in that said locking joint also comprised a circular pre-stressing element (10), which has a radially outer portion (11) abutting against an essentially axially facing surface of said sleeve formed end portion (5), preferably against its end surface, and which is arranged by means of a prestressing member (12) to be connected with the first rotor part (1) and to prestress it axially via a locking element (8) against the second rotor part (2).

2. Centrifugal separator according to claim 1, characterized in that said locking element (8) is constituted by a number of ring sections (27), which are axially conical in a way such that when they are located in said recess, which has the form of an annular groove (26), the main part of their axially outer end surface (28) is located radially outside said flange portion (3) of the first rotor part (1), whereas the main part of their axially inner end surface (29) is located radially inside the peripery of the flange portion (3).

3. Centrifugal separator according to claim 1 or 2, characterized in that said annular pre-stressing element (10) is provided with an annular flange (llA), which surrounds said sleeve formed end portion (5) and counteracts radial deflection of it during operation.

4. Centrifugal separator according to claim 1 or 2, characterized in that the pre-stressing member comprises a bolt joint (12).

5. Centrifugal separator according to claim 4, characterized in that the bolt joint comprises bolts (12), at least some of which are arranged to lock the locking element (8) in its position in the recess (7).

6. Centrifugal separator according to claims 1 or 2, characterized in that said pre-stressing element (10) has a portion, inserted into said sleeve formed end portion (5) to a position such that it is located radially inside the locking element (8) and locks the same in said recess (7).

7. Centrifugal separator according to claim 1 or 2 characterized in that the second rotor part comprises an elongated, substantially circular-cylindrical drum surrounding a screw conveyor (24) for the discharge of sludge, the end portion of the drum having also a circular-cylindrical outer surface.

* * * * *